US009596976B2

(12) United States Patent
McDaniel et al.

(10) Patent No.: US 9,596,976 B2
(45) Date of Patent: Mar. 21, 2017

(54) DISHWASHER APPLIANCE

(71) Applicant: General Electric Company, Schenectady, NY (US)

(72) Inventors: Aaron Matthew McDaniel, Pittsburgh, PA (US); John Edward Dries, Louisville, KY (US); Gregory Owen Miller, Louisville, KY (US); Craig Curtis, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 495 days.

(21) Appl. No.: 14/195,970

(22) Filed: Mar. 4, 2014

(65) Prior Publication Data

US 2015/0250374 A1 Sep. 10, 2015

(51) Int. Cl.
*A47L 15/50* (2006.01)

(52) U.S. Cl.
CPC ..... *A47L 15/505* (2013.01); *A47L 15/508* (2013.01)

(58) Field of Classification Search
None
See application file for complete search history.

(56) References Cited

U.S. PATENT DOCUMENTS

| | | | | |
|---|---|---|---|---|
| 7,475,696 | B2 * | 1/2009 | Vanderroest | A47L 15/16 134/94.1 |
| 7,914,625 | B2 | 3/2011 | Bertsch et al. | |
| 7,918,942 | B2 | 4/2011 | Nagel et al. | |
| 7,969,772 | B2 | 6/2011 | Gubbins et al. | |
| 8,161,995 | B2 | 4/2012 | Armstrong et al. | |

* cited by examiner

*Primary Examiner* — Michael Barr
*Assistant Examiner* — Jason Riggleman
(74) *Attorney, Agent, or Firm* — Dority & Manning, P.A.

(57) ABSTRACT

A dishwasher appliance is provided. The dishwasher appliance includes a rack assembly disposed within a wash chamber of a tub. First and second spray assemblies are positioned adjacent the rack assembly and configured for directing wash fluid towards the rack assembly. The dishwasher appliance also includes features for selectively directing wash fluid from a supply conduit to the second spray assembly.

19 Claims, 5 Drawing Sheets

DISHWASHER APPLIANCE

FIELD OF THE INVENTION

The present subject matter relates generally to dishwasher appliances.

BACKGROUND OF THE INVENTION

Dishwasher appliances generally include a tub that defines a wash chamber therein. Various spray assemblies may be disposed within the wash chamber. During operation of the dishwasher appliances, the spray assemblies direct wash fluid towards articles within rack assemblies in the wash chamber. Thus, the spray assemblies provide multiple outlets for directing wash fluid onto articles within the rack assemblies during operation of the dishwasher appliances.

In certain dishwasher appliances, wash fluid is directed to separate spray assemblies at a fixed ratio. Thus, a first one of the spray assemblies may receive about seventy percent of a flow of wash fluid from a supply conduit while a second one of the spray assemblies may receive about thirty percent of the flow of wash fluid from the supply conduit. The fixed ratio of wash fluid flow can provide a convenient distribution of wash fluid when both the first and second spray assemblies are needed but can be inefficient when either the first spray assembly or the second spray assembly is not needed.

Accordingly, a dishwasher appliance with features for regulating fluid flow to various spray assemblies of the dishwasher appliance would be useful. In particular, a dishwasher appliance with features for selectively directing wash fluid to a secondary spray assembly of the dishwasher appliance would be useful.

BRIEF DESCRIPTION OF THE INVENTION

The present subject matter provides a dishwasher appliance. The dishwasher appliance includes a rack assembly disposed within a wash chamber of a tub. First and second spray assemblies are positioned adjacent the rack assembly and configured for directing wash fluid towards the rack assembly. The dishwasher appliance also includes features for selectively directing wash fluid from a supply conduit to the second spray assembly. Additional aspects and advantages of the invention will be set forth in part in the following description, or may be apparent from the description, or may be learned through practice of the invention.

In a first exemplary embodiment, a dishwasher appliance is provided. The dishwasher appliance includes a tub that defines a wash chamber. A rack assembly is disposed within the wash chamber of the tub. A first spray assembly is positioned adjacent the rack assembly such that the first spray assembly is positioned for directing a first flow of wash fluid towards the rack assembly. A second spray assembly is positioned adjacent the rack assembly such that the second spray assembly is positioned for directing a second flow of wash fluid towards the rack assembly. The dishwasher appliance also includes a supply conduit and a manually actuated valve coupled to the supply conduit such that the manually actuated valve selectively permits wash fluid from the supply conduit to flow to the second spray assembly.

In a second exemplary embodiment, a dishwasher appliance is provided. The dishwasher appliance defines a vertical direction, a lateral direction and a transverse direction. The vertical, lateral and transverse directions are mutually perpendicular. The dishwasher appliance includes a tub that defines a wash chamber. The wash chamber extends between a top portion and a bottom portion along the vertical direction. A lower rack assembly is disposed within the wash chamber of the tub adjacent the bottom portion of the wash chamber. An upper rack assembly is disposed within the wash chamber of the tub and positioned above the lower rack assembly along the vertical direction. The upper rack assembly defines an interior volume for receiving articles for washing. A spray arm is rotatably mounted to the upper rack assembly. The spray arm is positioned for directing a first flow of wash fluid towards the interior volume of the upper rack assembly. A bottle washer assembly is also mounted to the upper rack assembly. The bottle washer assembly is positioned for directing a second flow of wash fluid towards the interior volume of the upper rack assembly. The dishwasher appliance also includes a supply conduit and a manually actuated valve. The manually actuated valve is coupled to the supply conduit such that the manually actuated valve selectively permits wash fluid from the supply conduit to flow to the bottle washer assembly.

In a third exemplary embodiment, a dishwasher appliance is provided. The dishwasher appliance includes a tub that defines a wash chamber. A rack assembly is disposed within the wash chamber of the tub. A first spray assembly is positioned adjacent the rack assembly such that the first spray assembly is positioned for directing a first flow of wash fluid towards the rack assembly. A second spray assembly is positioned adjacent the rack assembly such that the second spray assembly is positioned for directing a second flow of wash fluid towards the rack assembly. The dishwasher appliance also includes a supply conduit and means for selectively directing wash fluid from the supply conduit to the second spray assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
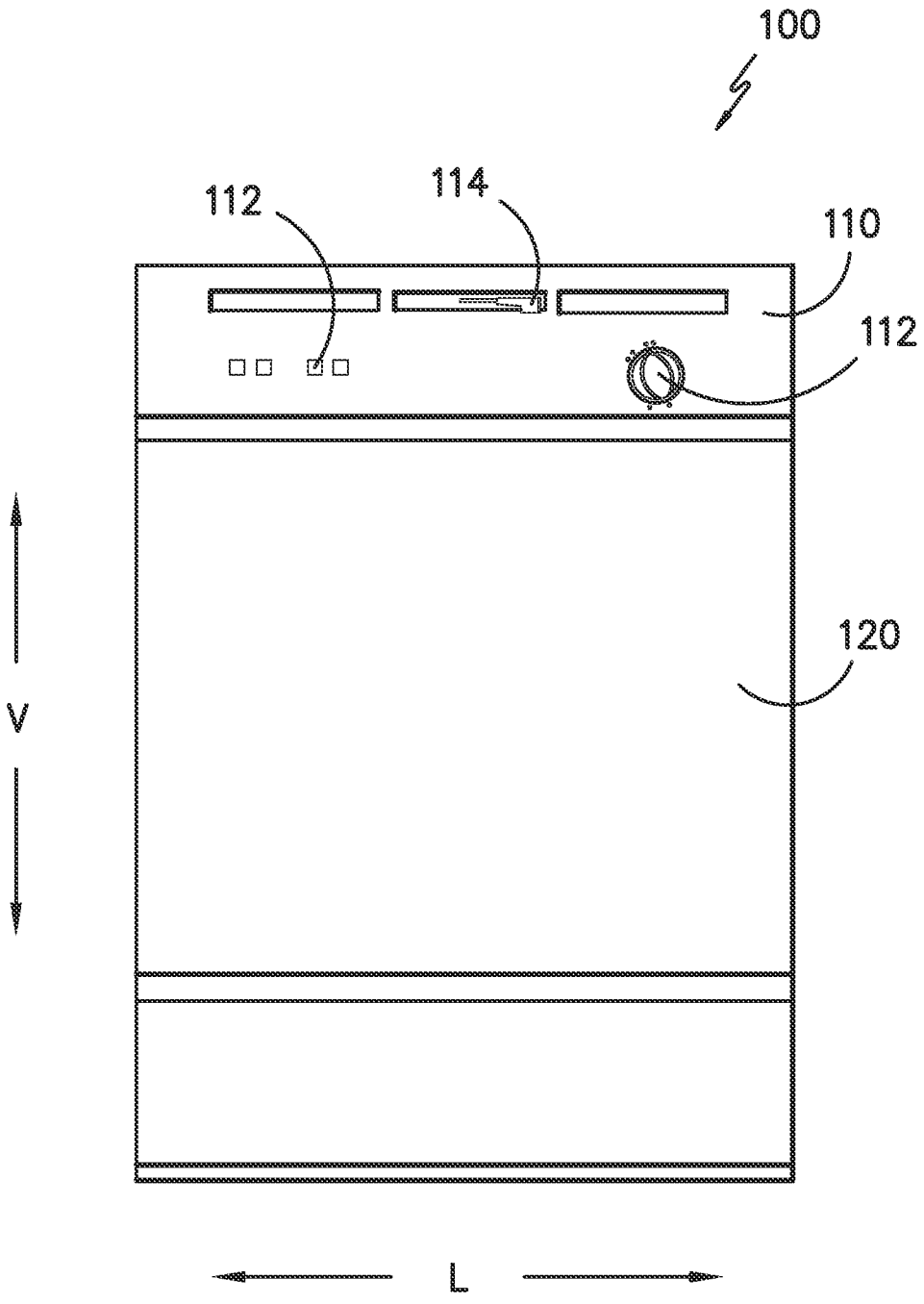
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
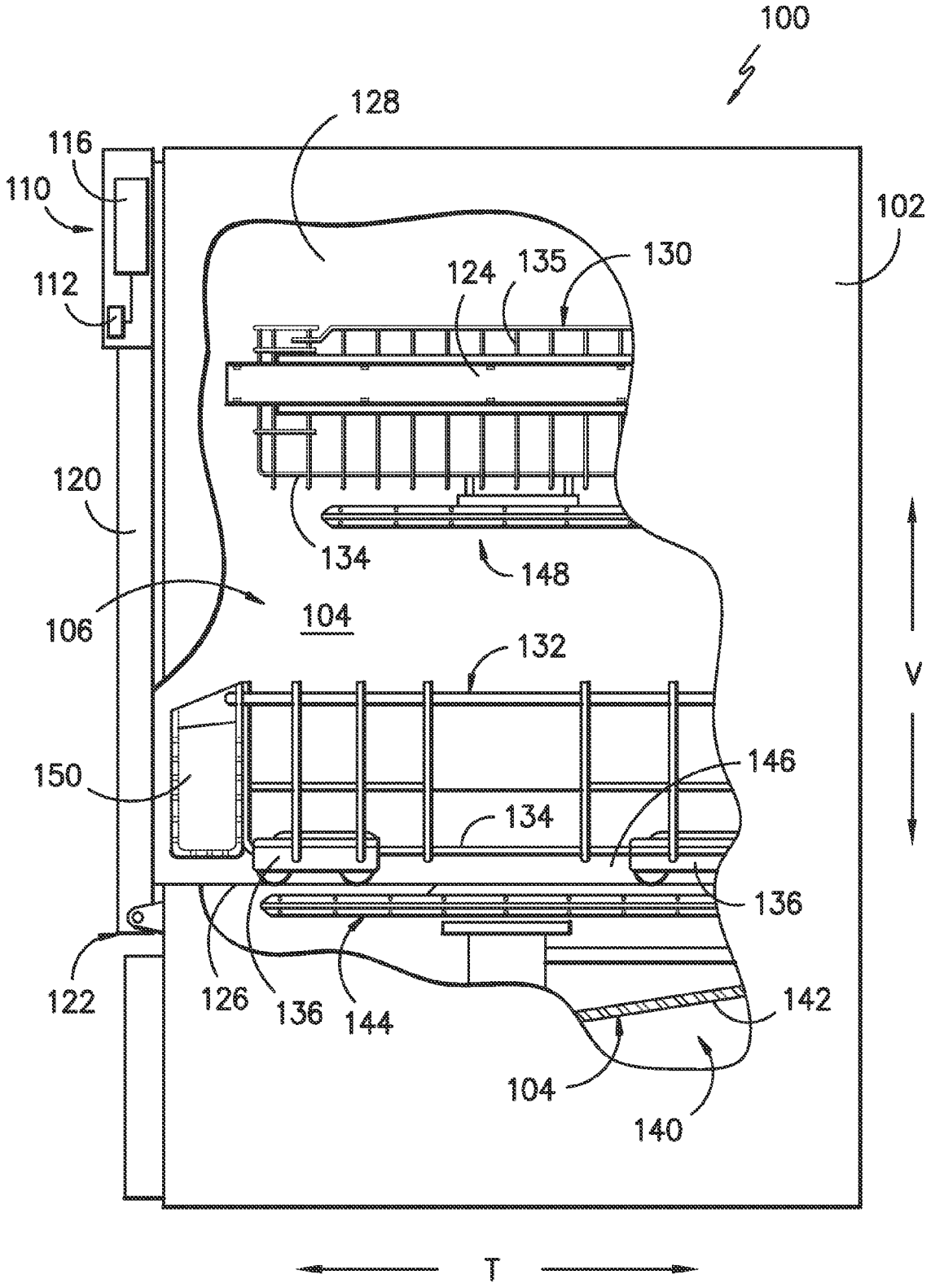
FIG. 2 provides a partial side section view of the exemplary dishwasher appliance of FIG. 1.

FIGS. 1 and 2 depict a dishwasher appliance 100 according to an exemplary embodiment of the present subject matter. Dishwasher appliance 100 defines a vertical direction V, a lateral direction L (FIG. 1) and a transverse direction T (FIG. 2). The vertical, lateral, and transverse directions V, L, and T are mutually perpendicular and form an orthogonal direction system.

Dishwasher appliance 100 includes a chassis or cabinet 102 having a tub 104. Tub 104 defines a wash chamber 106 and includes a front opening (not shown) and a door 120 hinged at its bottom 122 for movement between a normally closed vertical position (shown in FIGS. 1 and 2), wherein wash chamber 106 is sealed shut for washing operation, and a horizontal open position for loading and unloading of articles from dishwasher appliance 100. A latch 114 is used to lock and unlock door 120 for access to chamber 106.

Slide assemblies 124 are mounted on opposing tub sidewalls 128 to support and provide for movement of an upper rack assembly 130. Lower guides 126 are positioned in opposing manner of the sides of chamber 106 and provide a ridge or shelf for roller assemblies 136 so as to support and provide for movement of a lower rack assembly 132. Each of the upper and lower rack assemblies 130 and 132 is fabricated into lattice structures including a plurality of elongated members 134 and 135 that extend in lateral (L), transverse (T), and/or vertical (V) directions. Each rack assembly 130 and 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by slide assemblies 124 and roller assemblies 136 that carry the upper and lower rack assemblies 130 and 132, respectively. A silverware basket 150 may be removably attached to the lower rack assembly 132 for placement of silverware, small utensils, and the like, that are too small to be accommodated by the upper and lower rack assemblies 130 and 132.

Dishwasher appliance 100 also includes a lower spray assembly 144 that is rotatably mounted within a lower region 146 of the wash chamber 106 and above a tub sump portion 142 so as to rotate in relatively close proximity to lower rack assembly 132. A spray arm or mid-level spray assembly 148 is located in an upper region of the wash chamber 106 and may be located in close proximity to upper rack assembly 130. Additionally, an upper spray assembly (not shown) may be located above the upper rack assembly 130.

Lower and mid-level spray assemblies 144 and 148 and the upper spray assembly are fed by a fluid circulation assembly for circulating water and wash fluid in the tub 104. Portions of the fluid circulation assembly may be located in a machinery compartment 140 located below tub sump portion 142 of tub 104, as generally recognized in the art. Each spray assembly includes an arrangement of discharge ports or orifices for directing washing liquid onto dishes or other articles located in upper and lower rack assemblies 130 and 132, respectively. The arrangement of the discharge ports in at least the lower spray assembly 144 provides a rotational force by virtue of washing fluid flowing through the discharge ports. The resultant rotation of lower spray assembly 144 provides coverage of dishes and other articles with a washing spray.

Dishwasher appliance 100 is further equipped with a controller 116 to regulate operation of dishwasher appliance 100. Controller 116 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 116 may be positioned in a variety of locations throughout dishwasher appliance 100. In the illustrated embodiment, controller 116 may be located within a control panel area 110 of door 120 as shown. In such an embodiment, input/output ("I/O") signals may be routed between the control system and various operational components of dishwasher appliance 100 along wiring harnesses that may be routed through bottom 122 of door 120. Typically, the controller 116 includes a user interface panel 112 through which a user may select various operational features and modes and monitor progress of the dishwasher appliance 100. In one embodiment, user interface panel 112 may represent a general purpose I/O ("GPIO") device or functional block. In one embodiment, the user interface panel 112 may include input components, such as one or more of a variety of electrical, mechanical or electro-mechanical input devices including rotary dials, push buttons, and touch pads. User interface panel 112 may include a display component, such as a digital or analog display device designed to provide operational feedback to a user. User interface panel 112 may be in communication with controller 116 via one or more signal lines or shared communication busses.

It should be appreciated that the invention is not limited to any particular style, model, or configuration of dishwasher appliance. Thus, the exemplary embodiment depicted in FIGS. 1 and 2 is provided for illustrative purposes only. For example, different locations may be provided for a user interface 112, different configurations may be provided for upper and lower rack assemblies 130 and 132 and/or lower and mid-level spray assemblies 144 and 148, and other differences may be applied as well.

Figure 3:
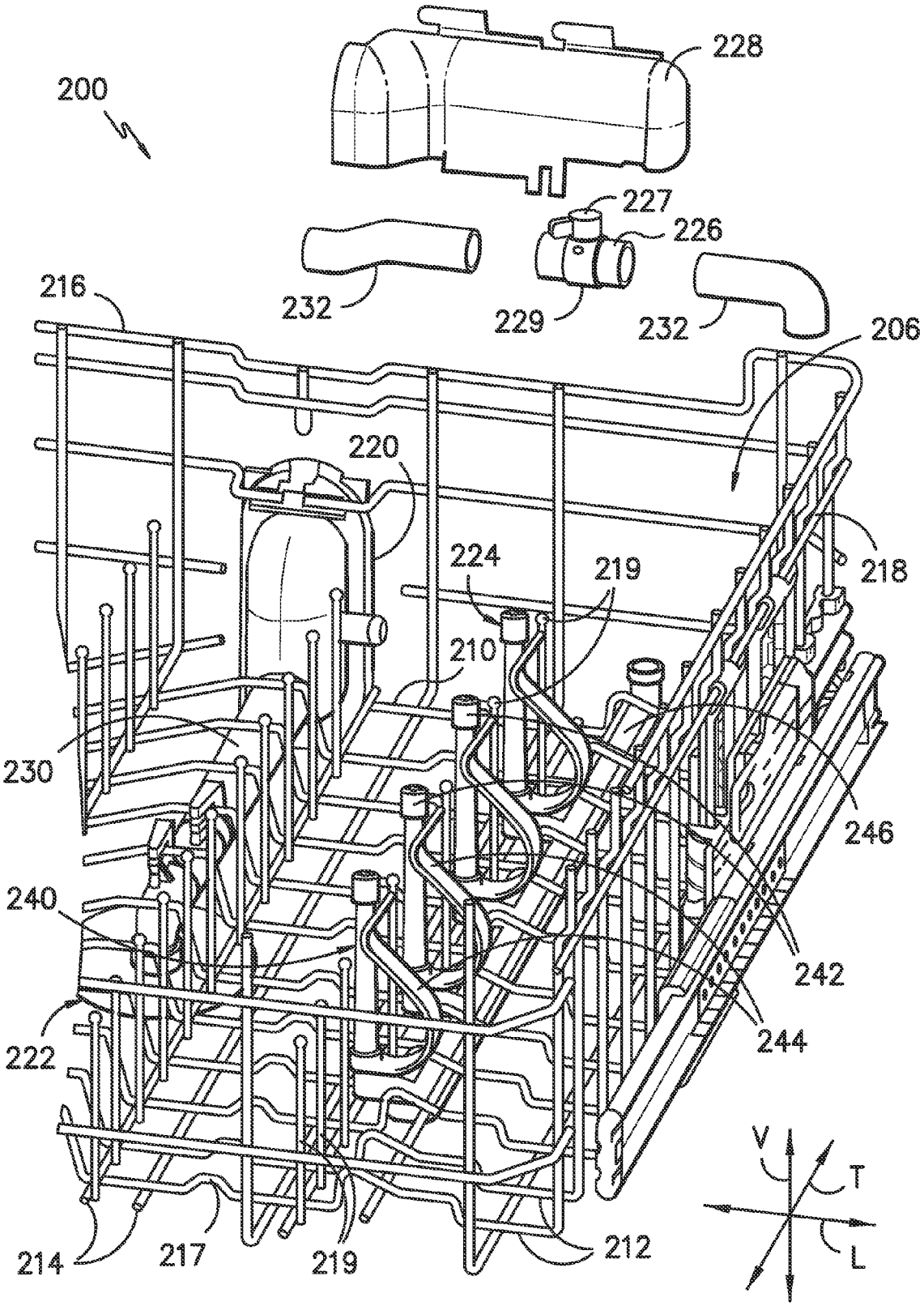
FIGS. 3 and 4 provide partial perspective views of a rack assembly according to an exemplary embodiment of the present subject matter.
Figure 4:
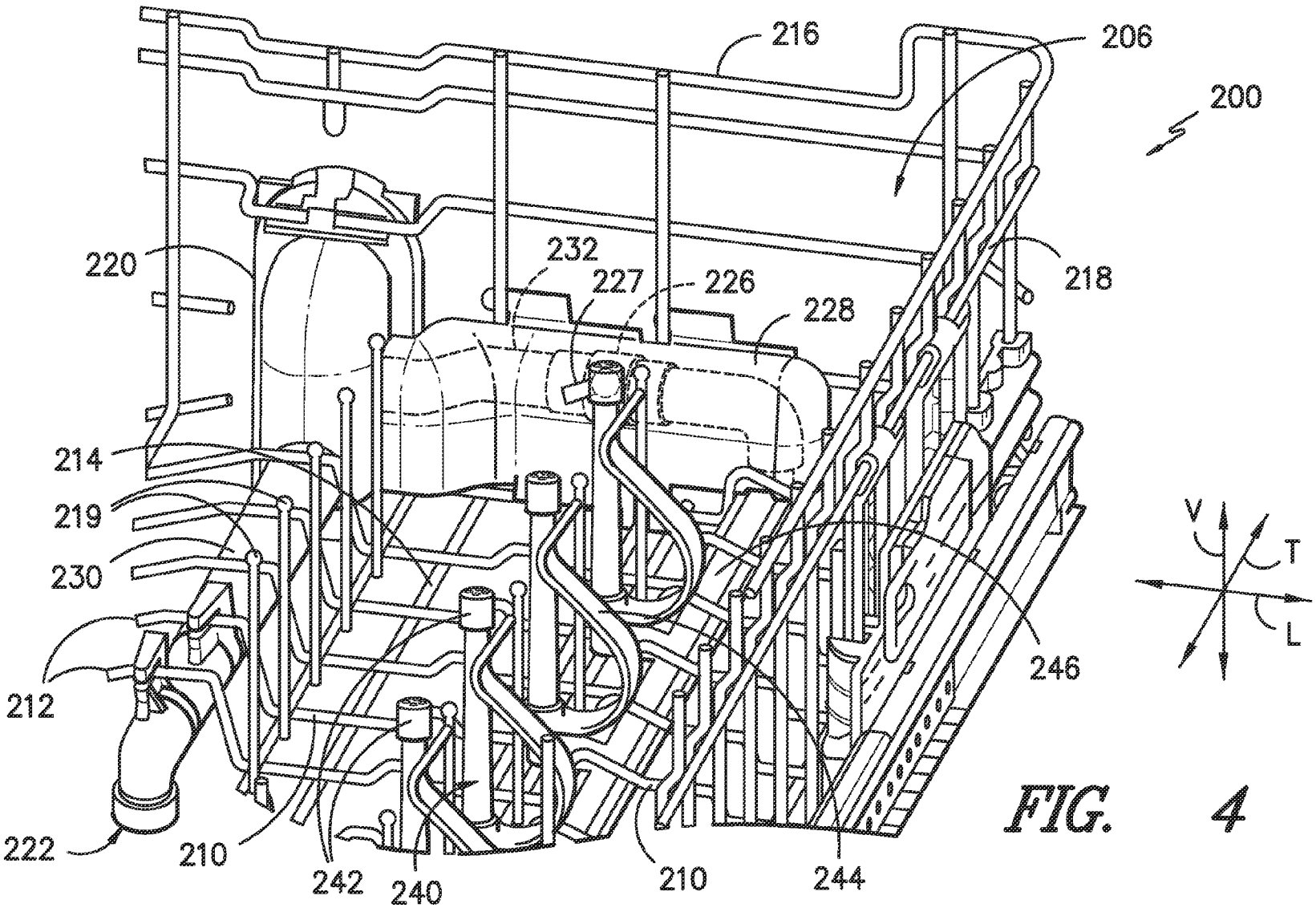

FIGS. 3 and 4 illustrate partial perspective views of a rack assembly 200 according to an exemplary embodiment of the present subject matter. Rack assembly 200 may be used in any suitable dishwasher appliance. As an example, rack assembly 200 may be utilized in dishwasher appliance 100, e.g., as upper rack assembly 130 (FIG. 2). Rack assembly 200 includes features for directing flows of wash fluid towards rack assembly 200 and for regulating the flows of wash fluid, as discussed in greater detail below.

As may be seen in FIG. 3, rack assembly 200 defines an interior volume 206. In particular, a bottom wall 210, a back wall 216, a front wall 217 and a side wall 218 of rack assembly 200 may assist with defining interior volume 206 of rack assembly 200. Thus, interior volume 206 of rack assembly 200 may be defined between bottom wall 210, back wall 216, front wall 217 and side wall 218 of rack assembly 200. Articles for washing, such as cups, bowls, bottles, etc., may be placed or positioned within interior volume 206 of rack assembly 200 such that the articles for washing are supported by rack assembly 200 during operation of dishwasher appliance 100.

Rack assembly 200 also includes a plurality of fixed tines 219 for assisting with supporting articles within interior volume 206 of rack assembly 200. Fixed tines 219 are mounted to bottom wall 210 of rack assembly 200 and extend into interior volume 206 of rack assembly 200, e.g., upwardly along the vertical direction V. In particular, as shown in FIG. 3, bottom wall 210 may include a series of lateral members 212 fixed to a series of transverse members 214. Each lateral member of lateral members 212 extends along the lateral direction L. Lateral members 212 are also spaced apart from one another along the transverse direction T. Similarly, each transverse member of transverse members 214 extend along the transverse direction T. Transverse members 214 are also spaced apart from one another along the lateral direction L. Thus, lateral members 212 and transverse members 214 form a lattice structure for containing articles within rack assembly 200. Fixed tines 219 may be mounted or fixed (e.g., welded) to lateral members 212 and/or transverse members 214 of bottom wall 210 of rack assembly 200 and extend into interior volume 206 of rack assembly 200, e.g., upwardly along the vertical direction V, from bottom wall 210.

Rack assembly 200 further includes a first spray assembly 222 and a second spray assembly 224. First and second spray assemblies 222 and 224 are positioned and oriented for directing respective flows of wash fluid towards interior volume 206 of rack assembly 200. The flows of wash fluid from first and second spray assemblies 222 and 224 assist with cleaning articles within interior volume 206 of rack assembly 200, as will be understood by those skilled in the art. Thus, rack assembly 200 includes features for, e.g., selectively, directing multiple flows of washing fluid into interior volume 206 of rack assembly 200.

First spray assembly 222 is positioned and/or oriented for directing a first flow of wash fluid towards or into rack assembly 200. In the exemplary embodiment shown in FIGS. 3 and 4, first spray assembly 222 may be a spray arm, such as mid-level spray assembly 148 of dishwasher appliance 100. Thus, first spray assembly 222 may be a spray arm rotatably mounted to rack assembly 200 at bottom wall 210 of rack assembly 200. In particular, first spray assembly 222 may be positioned below bottom wall 210 of rack assembly 200, e.g., along the vertical direction V, and direct the first flow of wash fluid towards or into rack assembly 200 through bottom wall 210.

Second spray assembly 224 is positioned and/or oriented for directing a second flow of wash fluid towards or into rack assembly 200. In the exemplary embodiment shown in FIGS. 3 and 4, second spray assembly 224 is shown as a bottle washer assembly 240. However, it should be understood that second spray assembly 224 may be any suitable spray assembly in alternative exemplary embodiments. For example, second spray assembly 224 may be a bowl scrubber, a rotatable spray arm, etc., in alternative exemplary embodiments.

Bottle washer assembly 240 is mounted to rack assembly 200 at bottom wall 210 of rack assembly 200. Bottle washer assembly 240 includes a plurality of spray tines 242. Bottles, such as baby bottles, cups, glasses, etc., may be positioned on and/or over spray tines 242. Spray tines 242 are mounted to a tube 246 of the bottle washer assembly 240 and extend into interior volume 206 of rack assembly 200, e.g., upwardly along the vertical direction V. In particular, spray tines 242 of bottle washer assembly 240 may be distributed between fixed tines 219 of bottom wall 210. For example, each spray tine of spray tines 242 of bottle washer assembly 240 may be positioned between respective pairs of fixed tines 219 as shown in FIGS. 3 and 4.

Spray tines 242 may assist with supporting articles within interior volume 206 of rack assembly 200. In addition, each spray tine of spray tines 242 emits a stream of wash fluid during operation of bottle washer assembly 240. The stream of wash fluid is directed against or onto a bottle or other container positioned over or on each respective one of spray tines 242. In such a manner, bottles and other containers may be more efficiently or completely washed or cleaned during operation of dishwasher appliance 100.

Bottle washer assembly 240 also includes a plurality of clips 244. Each clip of clips 244 is positioned and/or mounted to a respective one of spray tines 242. Clips 244 engage articles, such as bottles, disposed on or over spray tines 242 and hinder or prevent such articles from moving during operation of bottler washer assembly 240. Thus, as an example, when a stream of fluid from one of spray tines 242 impacts a bottle disposed over the one of spray tines 242, an associated one of clips 244 hinders or prevents the bottle from being ejected off the one of spray tines 242 by the stream of fluid.

To provide wash fluid to first spray assembly 222 and second spray assembly 224, rack assembly 200 includes a supply conduit 220. Supply conduit 220 is configured for receiving wash fluid during operation of an associated dishwasher appliance 100 and directing such wash fluid to first spray assembly 222 and/or second spray assembly 224. For example, supply conduit 220 may be in fluid communication with the fluid circulation assembly of dishwasher appliance 100 when rack assembly 200 is in a closed position. Thus, the fluid circulation assembly of dishwasher appliance 100, e.g., a recirculation pump (not shown) of the fluid circulation assembly, may direct wash fluid from tub sump portion 142 of tub 104 to supply conduit 220 during operation of dishwasher appliance 100.

Supply conduit 220 includes a first segment 230 that extends to or towards first spray assembly 222 and a second segment 232 that extends to or towards second spray assembly 224. First segment 230 of supply conduit 220 directs wash fluid therethrough to first spray assembly 222, e.g., during operation of dishwasher appliance 100. Second segment 232 of supply conduit 220 is configured for directing wash fluid to second spray assembly 224, e.g., during operation of dishwasher appliance 100.

Rack assembly 200 also includes features for regulating flows of wash fluid from supply conduit 220 to second spray assembly 224 (e.g., and first spray assembly 222). In particular, rack assembly 200 includes a manually operated or manually actuated valve 226 for selectively directing wash fluid from supply conduit 220 to second spray assembly 224, e.g., via second segment 232 of supply conduit 220. Manually actuated valve 226 is coupled to supply conduit 220, e.g., second segment 232 of supply conduit 220, such that manually actuated valve 226 selectively permits wash fluid from supply conduit 220 to flow to second spray assembly 224.

Manually activated valve 226 may be any suitable manually actuated valve. For example, manually actuated valve 226 may be a two-way ball valve, a three-way ball valve, a four-way ball valve, a needle valve, a butterfly valve, a paddle valve, etc. Manually actuated valve 226 may also be positioned at any suitable location on rack assembly 200 and/or on dishwasher appliance 100. For example, manually actuated valve 226 may be positioned on and/or mounted to rack assembly 200. In particular, manually actuated valve 226 may be positioned at and/or mounted to back wall 216 of rack assembly 200 as shown in FIG. 4. As another example, manually actuated valve 226 may be positioned within wash chamber 106 of tub 104 and mounted to tub 104. As an additional example, manually actuated valve 226 may be positioned outside of wash chamber 106 of tub 104 and mounted to tub 104.

In the exemplary embodiment shown in FIGS. 3 and 4, manually actuated valve 226 is shown as a two-way ball valve. The two-way ball valve is selectively adjustable between a first position and a second position. For example, a user of dishwasher appliance 100 may utilize a knob 227 of manually actuated valve 226 to manually actuate or adjust the two-way ball valve between the first and second positions. As will be understood by those skilled in the art, the two-way ball valve hinders or prevents wash fluid from supply conduit 220 from flowing to bottle washer assembly 240 through the manually actuated valve 226 when the two-way ball valve is in the first position. Conversely, the two-way ball valve permits wash fluid from supply conduit 220 to flow to bottle washer assembly 240 through manually actuated valve 226 when the two-way ball valve is in the second position. In such a manner, the user of dishwasher appliance 100 can utilize manually actuated valve 226 to selectively operate bottle washer assembly 240.

Manually actuated valve 226 can assist with increasing an efficiency of dishwasher appliance 100 and/or improving a consumer satisfaction with dishwasher appliance 100. For example, manually actuated valve 226 permits a user of dishwasher appliance 100 to manually deactivate bottle washer assembly 240 when bottle washer assembly 240 is not needed. By only directing wash fluid to bottle washer assembly 240 when needed, a supply of wash fluid to first spray assembly 222 can be increased when bottle washer assembly 240 is not required or in use.

Rack assembly 200 may also include a cover 228 for protecting manually actuated valve 226. Knob 227 of manually actuated valve 226 and a body 229 of manually actuated valve 226 may be positioned on opposite sides of cover 228 when cover 228 is positioned on or mounted to rack assembly 200 as shown in FIG. 4.

Figure 5:
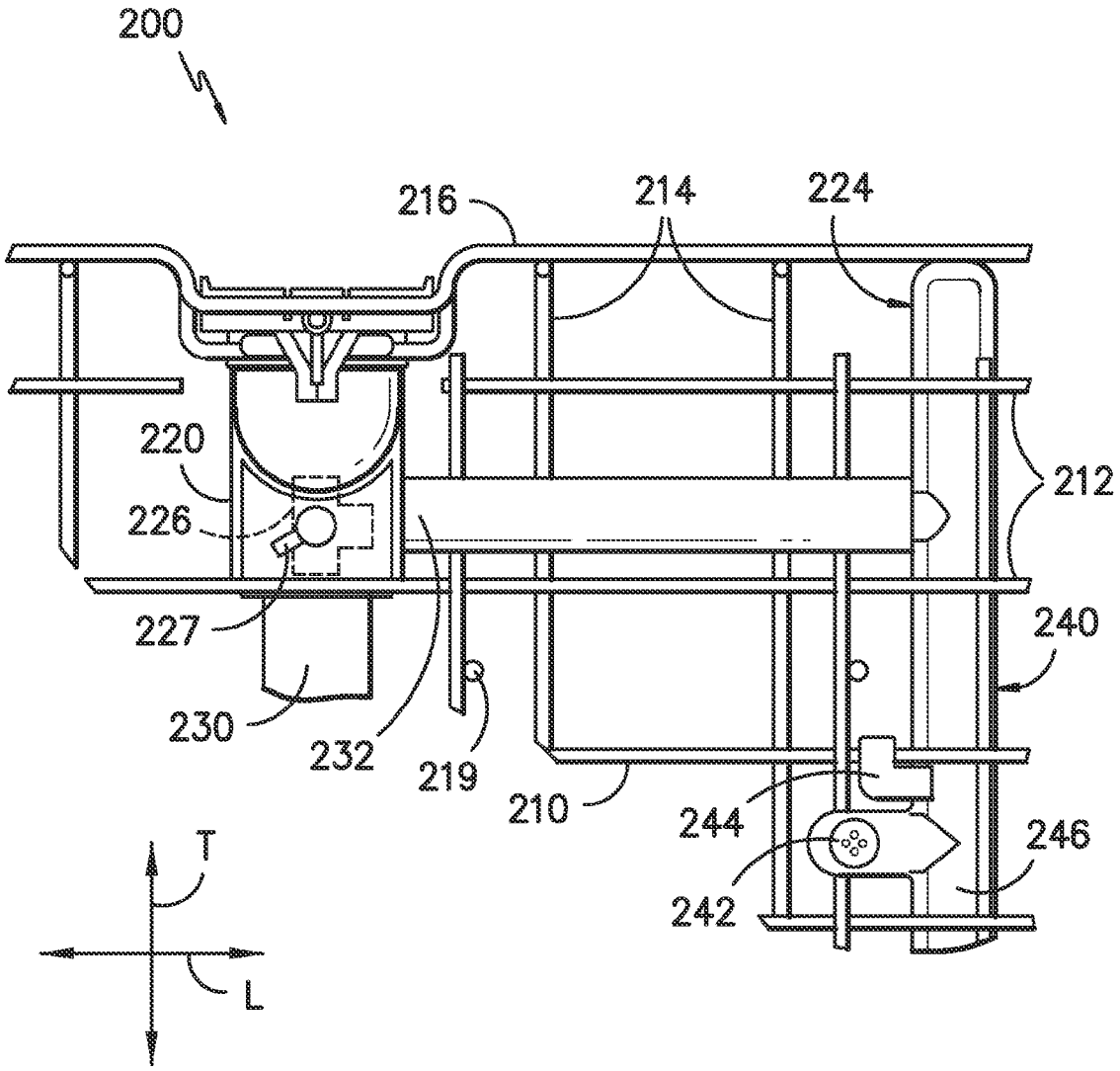
FIG. 5 provides a partial top plan view of a rack assembly according to another exemplary embodiment of the present subject matter.

FIG. 5 provides a partial top plan view of rack assembly 200 according to another exemplary embodiment of the present subject matter. In FIG. 5, manually actuated valve 226 is shown as a three-way ball valve. The three-way ball valve is selectively adjustable between a first position, a second position and a third position. For example, a user of dishwasher appliance 100 may utilize knob 227 of manually actuated valve 226 to manually actuate or adjust the three-way ball valve between the first, second and third positions. As will be understood by those skilled in the art, the three-way ball valve permits wash fluid from supply conduit 220 to flow to first spray assembly 222 through manually actuated valve 226 and hinders or prevents wash fluid from supply conduit 220 from flowing to bottle washer assembly 240 through the manually actuated valve 226 when the three-way ball valve is in the first position. Conversely, the three-way ball valve permits wash fluid from supply conduit 220 to flow to first spray assembly 222 and bottle washer assembly 240 through manually actuated valve 226 when the three-way ball valve is in the second position. In addition, the three-way ball valve hinders or prevents wash fluid from supply conduit 220 from flowing to first spray assembly 222 through manually actuated valve 226 and permits wash fluid from supply conduit 220 to flow to bottle washer assembly 240 through the manually actuated valve 226 when the three-way ball valve is in the third position. In such a manner, the user of dishwasher appliance 100 can utilize manually actuated valve 226 to selectively operate first spray assembly 222 and bottle washer assembly 240.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:
a tub defining a wash chamber;
a rack assembly disposed within the wash chamber of the tub;
a first spray assembly positioned adjacent the rack assembly such that the first spray assembly is positioned for directing a first flow of wash fluid towards the rack assembly;
a second spray assembly positioned adjacent the rack assembly such that the second spray assembly is positioned for directing a second flow of wash fluid towards the rack assembly;
a supply conduit; and
a manually actuated valve coupled to the supply conduit such that the manually actuated valve selectively permits wash fluid from the supply conduit to flow to the second spray assembly, the manually actuated valve positioned on the rack assembly.

2. The dishwasher appliance of claim 1, wherein the first spray assembly comprises a spray arm rotatably mounted to the rack assembly at a bottom wall of the rack assembly and the second spray assembly comprises a bottle washer assembly mounted to the rack assembly at the bottom wall of the rack assembly, the bottle washer assembly comprising a plurality of spray tines that extend away from the bottom wall of the rack assembly.

3. The dishwasher appliance of claim 1, wherein the bottle washer assembly further comprises a plurality of bottle clips, each bottle clip of the plurality of bottle clips positioned at a respective one of the plurality of spray tines of the bottle washer assembly.

4. The dishwasher appliance of claim 1, wherein the rack assembly comprises a plurality of fixed tines extending away from the bottom wall of the rack assembly, the plurality of spray tines of the bottle washer assembly distributed between the fixed tines of the plurality of fixed tines.

5. The dishwasher appliance of claim 1, wherein the manually actuated valve is positioned at a back wall of the rack assembly.

6. The dishwasher appliance of claim 1, wherein the manually actuated valve comprises a three-way ball valve, the three-way ball valve selectively adjustable between a first position and a second position, the three-way ball valve permitting wash fluid from the supply conduit to flow to the first spray assembly and hindering wash fluid from the supply conduit from flowing to the second spray assembly in the first position, the three-way ball valve permitting wash fluid from the supply conduit to flow to the first and second spray assemblies in the second position.

7. The dishwasher appliance of claim 1, wherein the manually actuated valve comprises a two-way ball valve, the two-way ball valve selectively adjustable between a first position and a second position, the two-way ball valve hindering wash fluid from the supply conduit from flowing to the second spray assembly in the first position, the two-way ball valve permitting wash fluid from the supply conduit to flow to the second spray assembly in the second position.

8. The dishwasher appliance of claim 1, wherein the rack assembly is an upper rack assembly, the upper rack assembly positioned at a top portion of the wash chamber.

9. The dishwasher appliance of claim 1, wherein the manually actuated valve is positioned within the wash chamber of the tub.

10. A dishwasher appliance defining a vertical direction, a lateral direction and a transverse direction, the vertical, lateral and transverse directions being mutually perpendicular, the dishwasher appliance comprising:

a tub defining a wash chamber, the wash chamber extending between a top portion and a bottom portion along the vertical direction;

a lower rack assembly disposed within the wash chamber of the tub and positioned adjacent the bottom portion of the wash chamber;

an upper rack assembly disposed within the wash chamber of the tub and positioned above the lower rack assembly along the vertical direction, the upper rack assembly defining an interior volume for receiving articles for washing;

a spray arm rotatably mounted to the upper rack assembly, the spray arm positioned for directing a first flow of wash fluid towards the interior volume of the upper rack assembly;

a bottle washer assembly mounted to the upper rack. assembly, the bottle washer assembly positioned for directing a second flow of wash fluid towards the interior volume of the upper rack assembly;

a supply conduit; and a manually actuated valve coupled to the supply conduit such that the manually actuated valve selectively permits wash fluid from the supply conduit to flow to the bottle washer assembly.

11. The dishwasher appliance of claim 10, wherein the spray arm is rotatably mounted to the upper rack assembly at a bottom wall of the upper rack assembly and the bottle washer assembly is mounted to the upper rack assembly at the bottom wall of the upper rack. assembly, the bottle washer assembly comprising a plurality of spray tines that extend away from the bottom wall of the upper rack assembly.

12. The dishwasher appliance of claim 11, wherein the bottle washer assembly further comprises a plurality of bottle clips, each bottle clip of the plurality of bottle clips positioned at a respective one of the plurality of spray tines of the bottle washer assembly.

13. The dishwasher appliance of claim 11, wherein the upper rack assembly comprises a plurality of fixed tines extending away from the bottom wall of the upper rack assembly, the plurality of spray tines of the bottle washer assembly distributed between the fixed tines of the plurality of fixed tines.

14. The dishwasher appliance of claim 10, wherein the manually actuated valve is positioned on the upper rack assembly.

15. The dishwasher appliance of claim 14, wherein the manually actuated valve is positioned at a back wall of the upper rack assembly.

16. The dishwasher appliance of claim 10, wherein the manually actuated valve comprises a three-way ball valve, the three-way ball valve selectively adjustable between a first position and a second position, the three-way ball valve permitting wash fluid from the supply conduit to flow to the spray arm and hindering wash fluid from the supply conduit from flowing to the bottle washer assembly in the first position, the three-way ball valve permitting wash fluid from the supply conduit to flow to the spray arm and the bottle washer assembly in the second position.

17. The dishwasher appliance of claim 10, wherein the manually actuated valve comprises a two-way ball valve, the two-way ball valve selectively adjustable between a first position and a second position, the two-way ball valve hindering wash fluid from the supply conduit from flowing to the bottle washer assembly in the first position, the two-way ball valve permitting wash fluid from the supply conduit to flow to the bottle washer assembly in the second position.

18. The dishwasher appliance of claim 10, wherein the manually actuated valve is positioned within the wash chamber of the tub.

19. A dishwasher appliance, comprising:

a tub defining a wash chamber;

a rack assembly disposed within the wash chamber of the tub;

a first spray assembly positioned adjacent the rack assembly such that the first spray assembly is positioned for directing a first flow of wash fluid towards the rack assembly;

a second spray assembly positioned adjacent the rack assembly such that the second spray assembly is positioned for directing a second flow of wash fluid towards the rack assembly;

a supply conduit; and means for selectively directing wash fluid from the supply conduit to the second spray assembly, the means for selectively directing wash fluid being manually adjustable at the rack assembly.

* * * * *